US005808508A

United States Patent [19]

Castellucci et al.

[11] Patent Number: 5,808,508

[45] Date of Patent: Sep. 15, 1998

[54] CURRENT MIRROR WITH ISOLATED OUTPUT

[75] Inventors: Gregg R. Castellucci, Plattsburgh, N.Y.; Steven J. Tanghe, Essex Junction, Vt.

[73] Assignee: International Business Machines Corporation, Armonk, N.Y.

[21] Appl. No.: 857,844

[22] Filed: May 16, 1997

[51] Int. Cl.[6] ..... G05F 3/26

[52] U.S. Cl. ..... 327/538; 327/543; 330/288; 323/312; 323/315

[58] Field of Search ..... 330/288; 327/538, 327/543; 323/315, 312, 317

[56] References Cited

U.S. PATENT DOCUMENTS

| | | | |
|---|---|---|---|
| 4,017,748 | 4/1977 | Davis | 307/296 R |
| 4,260,945 | 4/1981 | Ahmed | 323/316 |
| 4,412,184 | 10/1983 | Embree | 330/69 |
| 4,947,103 | 8/1990 | Abdi et al. | 323/316 |
| 4,958,090 | 9/1990 | Jansson | 307/456 |
| 5,124,632 | 6/1992 | Greaves | 323/316 |
| 5,124,667 | 6/1992 | Chevallier | 330/293 |
| 5,212,457 | 5/1993 | Frey et al. | 330/263 |
| 5,283,537 | 2/1994 | Nakamura | 330/288 |
| 5,349,287 | 9/1994 | Lorenz | 323/316 |
| 5,352,989 | 10/1994 | Toumazou et al. | 330/256 |
| 5,359,236 | 10/1994 | Giordano et al. | 307/310 |
| 5,461,343 | 10/1995 | Foran | 330/288 |
| 5,574,403 | 11/1996 | Kolluri | 330/288 |

OTHER PUBLICATIONS

International Business Machines Corporation Technical Disclosure Bulletin vol. 31 No. 5 Oct. 1988 Title: Oscillation–Free Current Source Bias With Compensation, Author: R. C. Wong.

*Primary Examiner*—Timothy P. Callahan
*Assistant Examiner*—An T. Luu
*Attorney, Agent, or Firm*—Eugene I. Shkurko

[57] ABSTRACT

An improved current mirror circuit with isolation of the output leg for improved stabilization of the circuit even when heavily loaded.

9 Claims, 2 Drawing Sheets

$I_{OUT} = I_{IN} - 2I_b$

CURRENT MIRROR WITH ISOLATED OUTPUT

BACKGROUND OF THE INVENTION

1. Technical Field of the Invention

This invention pertains to electrical circuits. In particular, this invention comprises an improved current mirror circuit with an isolated output leg to provide a stable current source and other advantageous isolation characteristics even when heavily loaded.

2. Background Art

Current mirror circuits are commonly used in analog applications where currents need to be duplicated or multiplied. Most of these circuits contain feedback loops that can become unstable when the output of the current mirror is heavily loaded with reactive elements.

Ideal current mirrors provide an output current equal to a reference input current, as illustrated in FIG. 1, wherein $I_{IN}=I_{OUT}$. In practice, conventional bipolar transistor current mirrors comprise at least two transistors as illustrated in FIG. 2, and do not perform ideally. As shown in FIG. 2, the output current $I_{OUT}$ does not equal $I_{IN}$ (control current) due to the base currents $I_b$ drawn by the two transistors. In this circuit, $I_{OUT}$ and $I_{IN}$ are related by the ratio of the emitter areas of the two transistors and by the amount of base current $I_b$ flowing into the bases of the two transistors. If the emitter areas are equal, i.e. well matched, and the base currents $I_b$ reduced to zero, then ideal performance could be achieved. By modifying the emitter areas of the two transistors the output current can be scaled up or down in proportion to the input current.

A well known improvement over this circuit is illustrated in FIG. 3 wherein compensating transistor Q1 reduces the amount of base current $I_b$, drawn by devices Q2 and Q3, and the deviation from ideal performance ($I_{IN}=I_{OUT}$) is reduced. Although the addition of Q1 improves performance, it introduces a feedback loop 31 which, due to its reactive response when the circuit is under load, can become unstable if not adequately compensated, as explained below.

As illustrated in FIG. 4, several output current devices 41 with common bases can be connected to Q3 to provide multiple current outputs. Each of these output currents is similarly related to the reference input current $I_{IN}$ as the current $I_{OUT}$ provided by Q3. That is, the current provided by these devices is proportional to the ratio of their emitter areas to the emitter area of Q2. Several such output devices may have their collectors coupled to a common node to provide a current multiple of the input $I_{IN}$ to that node. Diodes and/or resistors can be connected to the emitters of Q2, Q3, and devices 41 to help achieve matching transistor characteristics and to increase the output impedance.

The devices 41 coupled to the base of Q3 further compromises stability of the circuit by contributing poles to the loop 31 due to their inherent size and capacitive characteristics. Loads at the output of Q3 (collector) can even couple back into the loop through Q3 and contribute to instability. The feedback loop can be made stable by introducing a dominant pole such as that produced when capacitor 40 is added, as shown in FIG. 4. The added pole, however, reduces the frequency response of the current mirror.

It is an object of the invention to overcome the problems described above and to provide a current mirror circuit having stable performance under heavy loads.

SUMMARY OF THE INVENTION

A current mirror circuit is described including a transistor for isolating an output leg of the circuit to prevent reactive components in the load, coupled to the output leg, from destabilizing a loop formed near the input of the circuit. The output leg does not have any nodes in common with the loop.

Other features and advantages of this invention will become apparent from the following detailed description of the presently preferred embodiment of the invention, taken in conjunction with the accompanying drawings.

BEST MODE FOR CARRYING OUT THE INVENTION

Figure 1:
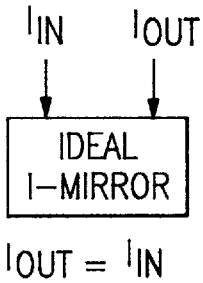
FIG. 1 illustrates an ideal current mirror.
Figure 2:
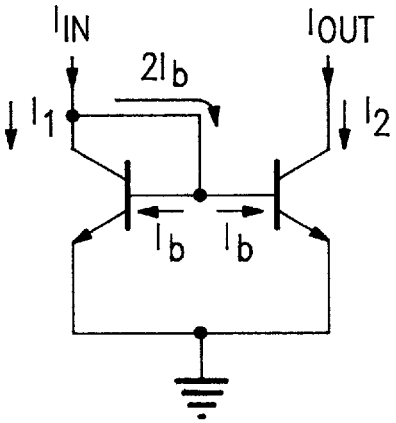
FIG. 2 illustrates a simple current mirror.
Figure 3:
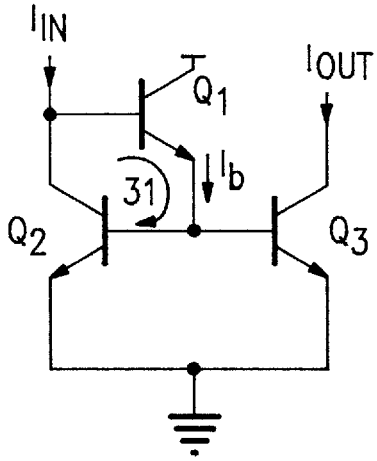
FIG. 3 illustrates a base current compensated current mirror.
Figure 4:
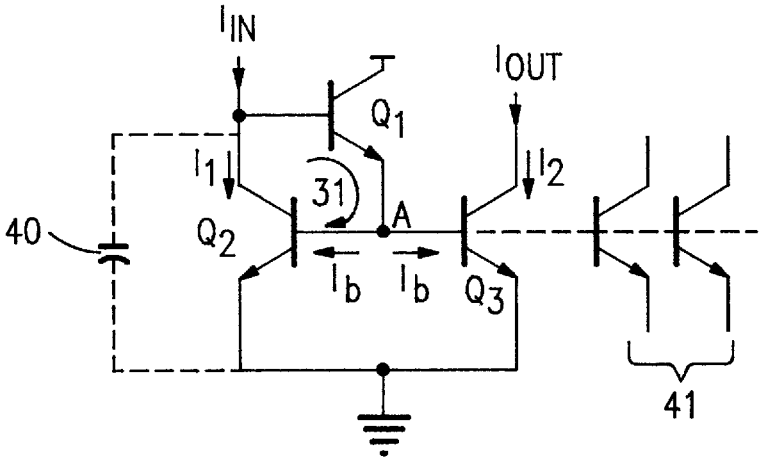
FIG. 4 illustrates a base current compensated current mirror with added loads.

Referring to FIG. 2, the current mirror shown deviates from ideal performance in that, although $I_1=I_2$, the $I_b$ currents are drawn from $I_{IN}$ and the circuit does not perform ideally, that is, for the circuit shown, $I_{IN}$ does not precisely equal $I_{OUT}$. FIG. 3 illustrates another prior art circuit which reduces $I_b$ current by including current compensating device Q1, however, this compensating device creates a feedback loop 31, comprising Q1 and Q2, which can destabilize the circuit. Referring to FIG. 4, instability in the loop, such as ringing or other uncontrolled oscillations, is worsened by increasing the amount of devices 41 coupled to the base of Q3 (referred to herein as the current mirror load device). Stabilization capacitor 40 could be added as shown to reduce instability concerns, however, the time response of the circuit to changes in input current is degraded. Another option is to replace the device Q1 by an FET to reduce $I_b$ current to almost zero.

Figure 5:
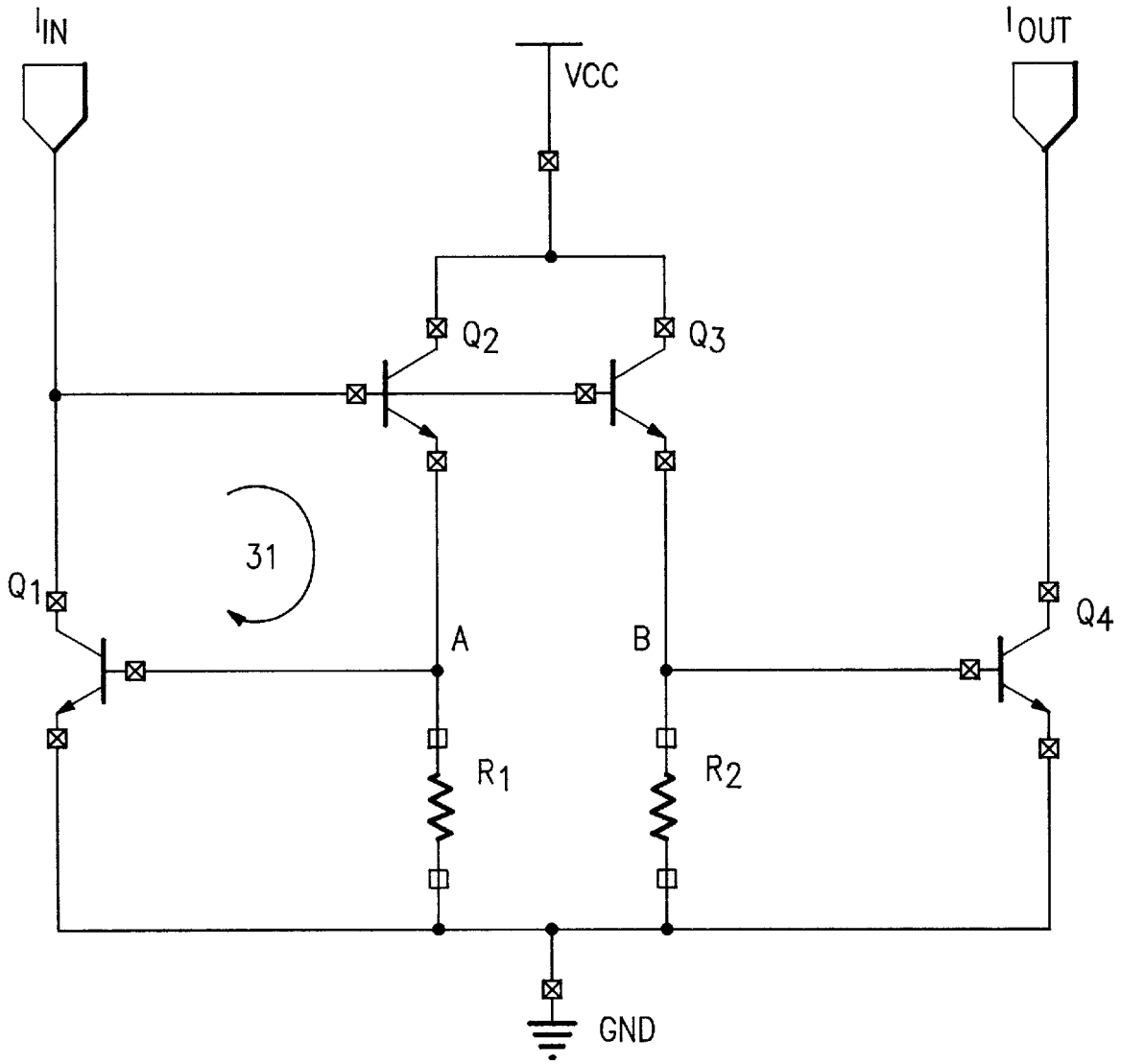
FIG. 5 illustrates the improved, isolated current mirror of the present invention.

FIG. 5 illustrates the present novel circuit. Isolating device, or buffer, Q3, in combination with decoupling the single node A of FIG. 4 into nodes A and B, isolates output device Q4 from the loop 31 comprising Q1 and Q2. Q3 acts as a buffer, such that the loading associated with output device Q4 is significantly reduced at the loop. Thus, stability concerns are limited to the input devices Q1 and Q2, with little effect from the output. Reactive compensation requirements for the loop are minimal which maintains fast performance of the circuit. Q2 and Q3 could also be replaced with FETs, which draw almost no current. Moreover, the circuit would also perform if resistors $R_1$ and $R_2$ are removed.

Alternative Embodiments

The matter contained in the above description or shown in the accompanying drawings have been described for purposes of illustration and shall not be interpreted in a limiting sense. It will be appreciated that various modifications may be made in the above structure and method without departing from the scope of the invention described herein. Thus, changes and alternatives will now become apparent to those skilled in the art without departing from the spirit and scope of the invention as set forth in the following claims. Accordingly, the scope of protection of this invention is limited only by the following claims and their equivalents.

What is claimed is:

1. Apparatus comprising:

first, second, third, and fourth transistors the first and second transistors both coupled to a voltage terminal and having their bases coupled directly to a control node;

the third transistor coupled directly to both a base and emitter of the first transistor, to the control node, and to ground; and the fourth transistor having its base coupled directly to the second transistor, the ground, and to an output for providing thereto an output current proportional to an input current received at the control node.

2. Apparatus of claim 1 further comprising a first resistor coupled to the first and third transistors, and to the ground.

3. Apparatus of claim 2 further comprising a second resistor coupled to the second and fourth transistors, and to the ground.

4. In a compensated current mirror circuit having a compensating transistor coupled directly to a voltage terminal, an input transistor coupled directly to an input node for receiving an input current, and having a current mirror load transistor coupled directly to an output node for providing an output current proportional to the input current, the improvement comprising: an isolating transistor coupled in series between the compensating transistor and the load transistor such that an electrical path from the in-put node to the output node includes, in order, only the compensating transistor, the isolating transistor, and the load transistor, and wherein the isolating transistor is coupled to the voltage terminal.

5. The improvement of claim 4 further comprising a first resistor coupled between the compensating transistor and ground.

6. The improvement of claim 5 further comprising a second resistor coupled between the isolating transistor and ground.

7. A circuit comprising:

a pair of transistors both coupled to a voltage terminal and both having their bases coupled to an input node;

a third transistor coupled directly to the input node and to ground, and having its base coupled directly to one of the pair of transistors; and a fourth transistor coupled to an output node for providing an output current in response to an input current received at the input node, the fourth transistor coupled to the ground and having its base coupled directly to another of the pair of transistors.

8. The circuit of claim 7 further comprising a first resistor coupled to both the third transistor and said one of the pair of transistors and to the ground.

9. The circuit of claim 8 further comprising a second resistor coupled to both the fourth transistor and said another of the pair of transistors and to the ground.

* * * * *